US009468930B2

(12) United States Patent
Alfee

(10) Patent No.: US 9,468,930 B2
(45) Date of Patent: Oct. 18, 2016

(54) ROTATABLE THROAT ASSEMBLY FOR COAL PULVERIZER

(71) Applicant: Bruce N Alfee, Palm City, FL (US)

(72) Inventor: Bruce N Alfee, Palm City, FL (US)

(73) Assignee: Techinomics, Inc., Pittsburgh, PA (US)

( * ) Notice: Subject to any disclaimer, the term of this patent is extended or adjusted under 35 U.S.C. 154(b) by 156 days.

(21) Appl. No.: 14/202,819

(22) Filed: Mar. 10, 2014

(65) Prior Publication Data

US 2015/0251185 A1 Sep. 10, 2015

(51) Int. Cl.
*B02C 15/00* (2006.01)

(52) U.S. Cl.
CPC ..... *B02C 15/001* (2013.01)

(58) Field of Classification Search
CPC ..... B02C 15/001
USPC ..... 241/119
See application file for complete search history.

(56) References Cited

U.S. PATENT DOCUMENTS 2,264,041 A 4/1981 Kitto, Jr. et al.
4,687,145 A * 8/1987 Dougan ..... B02C 15/001 241/103
4,721,258 A * 1/1988 Dougan ..... B02C 15/001 241/103
5,020,734 A 6/1991 Novotny et al.
5,054,697 A * 10/1991 Provost ..... B02C 15/001 241/119
5,127,590 A 7/1992 Bunton
5,340,041 A 8/1994 Henning et al.
5,549,251 A 8/1996 Provost
5,667,149 A * 9/1997 Eisinger ..... B02C 15/001 241/119
5,908,167 A 6/1999 Provost
7,100,853 B2 9/2006 Wark
7,584,918 B1 9/2009 Briggs, Jr. et al.
2011/0168819 A1* 7/2011 Wark ..... B02C 15/04 241/119
2012/0138718 A1 6/2012 Daimaru et al.

OTHER PUBLICATIONS

Alstom Power, Inc., PV-PRO 89 System, www.service.power.alstom.com 2009 USA.

* cited by examiner

*Primary Examiner* — Faye Francis
*Assistant Examiner* — Onekki Jolly

(57) ABSTRACT

A rotatable throat assembly for a coal pulverizer which includes a plurality of throat segments secured to a ring seat in the pulverizer, a plurality of ledge cover segments on the throat segments, and a plurality of air seal segments secured on top of the ledge cover segments wherein the air seal segments each includes a layer of flexible, durable, high temperature-resistant polymer/rubber material projecting to within close proximity to the inner wall of the pulverizer to substantially block air flow between the rotatable throat assembly and the inner wall of the pulverizer.

17 Claims, 4 Drawing Sheets

ROTATABLE THROAT ASSEMBLY FOR COAL PULVERIZER

FIELD OF THE INVENTION

This invention relates to pulverizers, particularly as are designed for use in pulverizing coal for power generation and the like. The invention comprises a rotating throat and ledge cover assembly for such pulverizers.

BACKGROUND OF THE INVENTION

The basic idea of a firing system using pulverized coal is to use the furnace for the combustion of solid fuels. Coal is ground to the size of a fine grain, mixed with air and burned in the flue gas flow. High velocity airflow is required to move the coal through the pulverizer. Coal contains mineral matter including rocks and aggregate, which is converted to ash during combustion. The ash is removed as bottom ash and fly ash. The bottom ash is removed at the furnace bottom. Coal that has been pulverized into a fine powder stems will burn almost as easily and efficiently as a gas. Pieces of coal are crushed by balls or cylindrical rollers that move between two tracks or races. The raw coal is then fed into the pulverizer along with air heated to about 350-450 degrees F. from the boiler. As the coal is crushed by the rolling action, the hot air dries it and blows the usable fine coal powder out to be used as fuel. The powdered coal from the pulverizer is directly blown to a burner in the boiler. Due to the nature of the pulverizer that uses heated high velocity air flow and which pulverizes coal containing rocks and other foreign materials, pulverizers are typically plagued by wear problems due to erosion of the parts in the pulverizer. Required repair and replacement of worn parts can involve prolonged shut down of the pulverizers and loss of production for several days.

As shown in FIG. 1, the overall design of a vertical spindle coal pulverizer is generally that of a prior art Babcock and Wilcox pulverizer model MPS-89. Raw coal is fed into the top of the pulverizer 10 through the raw coal pipe 11 and descends to the grinding ring 12 where it is broken by grinding wheels 13. The grinding ring 12 has a base or yoke 15 turned by a motor shaft 16, resulting in the rotation of the grinding wheels 13 on the grinding ring 12. The pulverized coal is centrifugally thrust by the rapid turning of the grinding ring across air channels 18 of throat ring 19. Throat ring 19 concentrically surrounds the coal grinding assembly such that all of the pulverized coal passes over the throat ring 19 and the air channels 18. The grinding table includes a ring seat that may be either a single-piece casting or a weldment, and contains a plurality of grinding segments that form a circular track in which the heavy grinding rolls contact and crush the coal. The inner wall of the pulverizer is typically steel or cast steel and has an inner layer of ceramic tile on it above the rotating throat assembly to provide wear resistance for the wall surface.

Forced air is supplied through air inlet 21 to and through the air channels 18 of the throat ring. Primary air is preheated by a primary heater before the air enters the mill. The primary air inlet temperature varies for different coal types, moisture content, etc. Typically, the primary air inlet temperature ranges from about 250 F-475 F. The primary air inlet temperature is set in order to maintain a consistent outlet temperature at which the air/fuel mixture is sent to the burners. The classifier 22 functions to segregate the coal which is fine enough to be burned from that which must be returned to the pulverizer because it is still too large. The relatively fine coal is carried with the air to the boiler through discharge turret 24 and burner pipes 11A, partially controlled by burner pipe valves 25, while the recycled larger particles fall back to the grinding ring 12 by way of classifier cone 26. Relatively dense mineral particles hopefully find their way to pyrites box 14.

U.S. Pat. Nos. 5,549,251 and 5,908,167, which are assigned to Techinomics, Inc., disclose rotating throat assemblies for coal pulverizers in which primary air performs four functions in the pulverizer: (1) drying of the coal in the pulverizer, (2) maintaining a fluidized bed of coal, which circulates coal into the path of the grinding elements, (3) transporting the coal particles from the fluidized bed into the classifier assembly, where large particles are separated for return to the grinding elements, and (4) transporting suitably pulverized coal particles out of the classifier to the burners. U.S. Pat. No. 5,549,251 discloses an cylindrical air seal (unnumbered and not explained) on the wall of the pulverizer adjacent the upper edge of the rotatable throat assembly in the pulverizer and a support ring 30 on the wall of the pulverizer adjacent the lower edge of the rotatable throat assembly. Techinomics' rotating throat assemblies are particularly efficient in the use of the primary by providing higher air velocities without increasing the air flow mass. There is a very wide range of cfm PA (primary air) feeding the mill. This is dependent on the size/capacity of the mill in tons, mill loading, coal type & moisture, altitude, etc.

Babcock & Wilcox's U.S. Pat. No. 5,340,041 discloses a replaceable passage arrangement for a pulverizer having a fixed housing with a central axis. The replaceable passage design consists of a passage segment, which comprises a number of individual parts, which are attached or welded together. Each passage segment has an inner rail and outer rail, which are spaced parallel from each other and secured in position by a plurality of ribs. The passage segment is mounted with fasteners and/or welding, to the grinding table. A replaceable ledge cover assembly is secured to the wall of the pulverizer and forms an inlet cone around the axis of the pulverizer for the flow of primary air.

Separation of the smaller and larger coal particles and recycling of the larger ones is common to most, if not all, pulverizer designs. The task is complicated, however, by the presence of relatively dense non-combustible materials, i.e. rock, which is incidentally introduced as part of the coal feed. Where the machine functions to recycle such non-combustible materials rather than separating them out, the inefficiency is manifest. The machine not only expends unnecessary energy on recirculating and regrinding a material of zero fuel value, but does so at the cost of considerable wear. If somehow the rock particles are not rejected from the coal being processed, they must be reduced in size until they can mix with the coal particles transported to the burners. The presence of rock particles in the fuel stream reduces combustion efficiency and also results in a greater and faster buildup of ash in the combustion chamber, further reducing boiler efficiency by retarding heat transfer from the combustion chamber.

An improved coal pulverizer is needed that will provide high efficiency while minimizing wear of the pulverizer and shorten the time required to replace or repair worn parts in the pulverizer.

SUMMARY OF THE INVENTION

The present invention is an improvement to the rotating throat assembly covered by Provost U.S. Pat. No. 5,549,251, which is commonly owned with this application and which covers rotatable throat and ledge cover assemblies for pulverizers. This invention provides improved air seals for rotatable throat assemblies to improve airflow management and substantially reduce maintenance time and costs.

DESCRIPTION OF PREFERRED EMBODIMENTS

This invention provides air seals on a rotatable throat assembly for a coal pulverizer to improve airflow management. Such improved air flow management results in substantial reduction in maintenance costs and in shut-down time of the pulverizer for replacement or repair of the rotating throat assembly and pulverizer. This invention reduces the time of shut-downs for repair and replacement from several days to less than one day. Such reduction in shut-down time substantially increases production of the pulverizer and improves profitability. Rotating throats of this invention are proven to remove significant quantities of mercury and arsenic with the rejected rock, resulting in less contamination of SCR catalyst and low SCR chemical costs.

Figure 1:
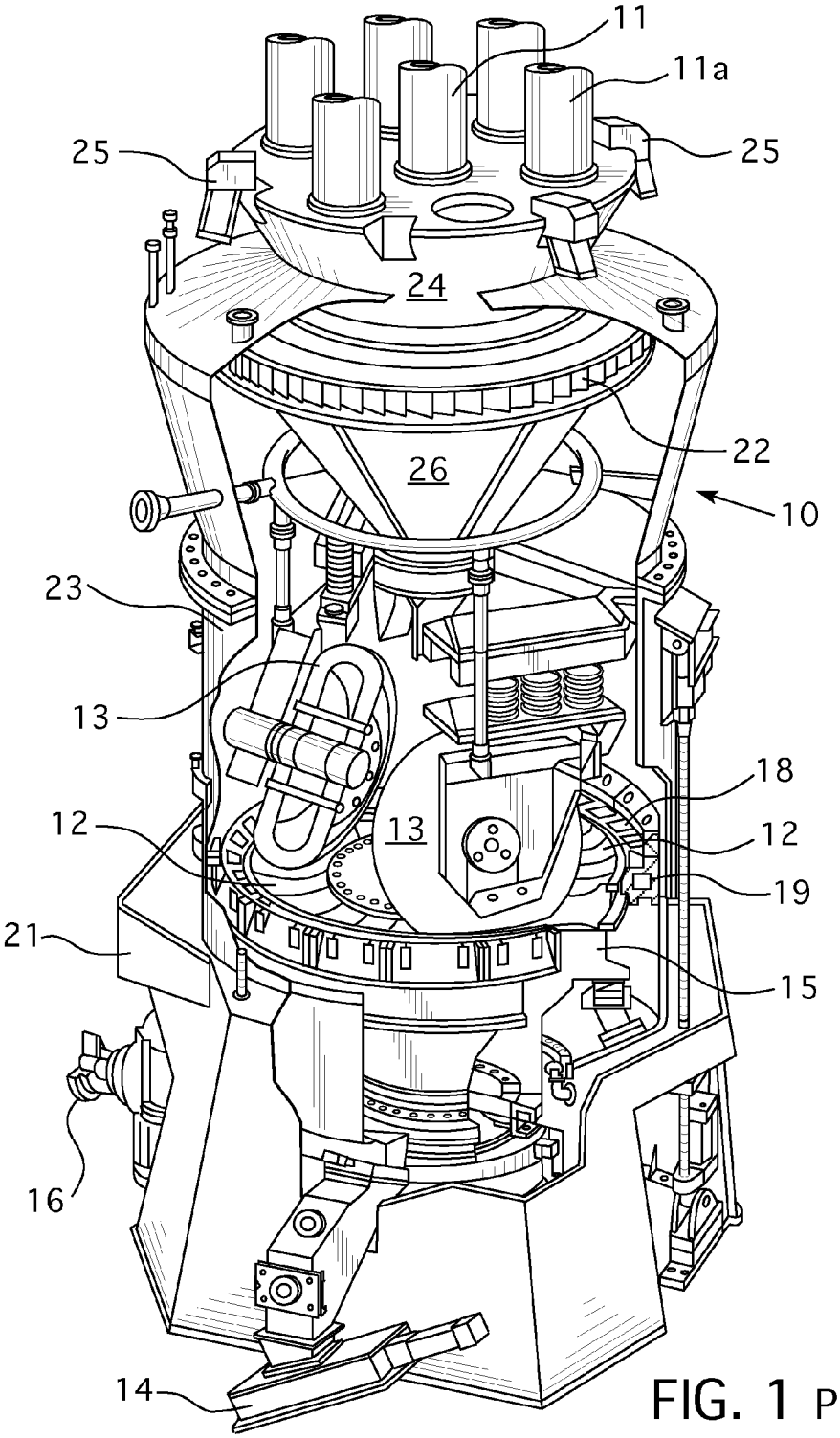
FIG. 1 Prior Art
FIG. 1 is a perspective view of a prior art pulverizer assembly, showing the position of the throat and the air passages through it.
Figure 2:
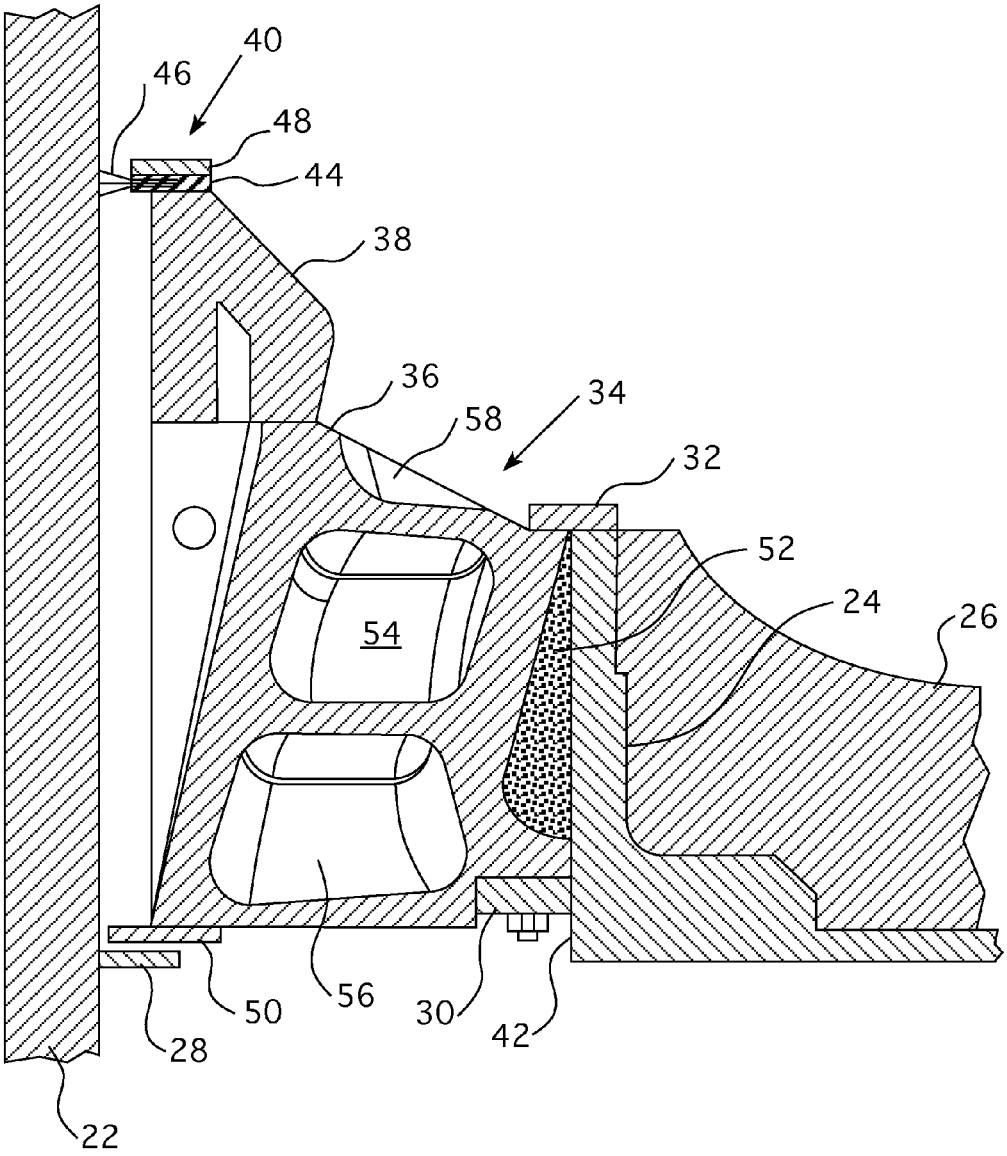
FIG. 2 is a cross sectional view of a new rotatable throat assembly of this invention and its relationship to a coal pulverizer.

FIG. 2 shows a rotatable throat assembly 34 of this invention mounted in a coal pulverizer that, in part, comprises an inner wall housing 22, a grinding table/ring seat 24, and grinding ring 26. The grinding table 24 and grinding ring 26 are rotatable in the pulverizer and are centered within the stationary inner wall housing 22.

The rotatable throat assembly 34 of this invention, as shown in FIGS. 2-5, comprises a plurality of throat segments 36, a plurality of ledge cover segments 38, and a plurality of upper air seal segments 40. The exact number of the segments 36, 38 and 40 is variable depending on the design of the pulverizer, provided that the segments of each kind total 360 degrees. For example, a throat assembly 34 may comprises six (6) 60 degrees segments of each the throat segments 36, ledge cover segments 38 and upper air seal segments, or alternatively twelve (12) 30 degrees segments of each to facilitate easier handling and a better fit in a mill body that is out-of-round. Another alternative would be to have fourteen (14) 25.715 degree throat segments 36 and ledge cover segments 38, and the same, more, or fewer upper air seal segments 40 than throat and ledge cover segments. The segments 36, 38 and 40 are preferably secured in overlapping arrangement, like bricks are laid, so the joints between segments in the layers of segments are not in vertical alignment.

The upper air seal segments 40 may be shorter or longer than the throat segments 36 and ledge cover segments 38. Rotating throats assemblies 34 of this invention are preferably dimensioned to permit changing the upper air seal segments 40 without the need for a worker to enter or work within the confined space of the mill, and instead to permit a worker to accomplish that task by reaching through a small access door (not shown) through the inner wall 22 of the pulverizer. The air seal segments may be shorter in length than the throat and ledge cover segments 36, 38 to facilitate replacement of the upper air seal segments.

The width of the air upper air seal 40 depends on the mill size and type, typically in the range of about 3" to 4." The upper air seal can be as thin as ½", but more preferably has a thickness between ⅝" to ¾" (for increased wear life). The dimensions, material, length, width, & thickness of the "rotating air seal" can vary depending on several factors including the design of the pulverizer in which the rotating throat 34 is mounted and the operating variables for the pulverizer among other factors.

In the embodiment selected for illustration, a mounting ring 30 is welded on the ring seat 24 of the pulverizer near the bottom of the outer face 42 of the ring seat for attachment of the throat segments 36. A table seal 32 is preferably welded to the upper surface of the ring seat 28 at the outer periphery of the ring seat and partially overlies the inner top edge of the throat segments 23.

As seen in FIG. 2, the throat segments 36 and ledge cover segments 38 are preferably spaced approximately 2 inches from the inner wall 22 of the pulverizer, but the spacing can vary depending on the specific upper air seal 40 that is used and the particular pulverizer in which the rotating throat 34 is mounted. This invention provides an upper air seal 40 to substantially block air flow between the ledge cover segments 36 and the wall 22.

In a preferred embodiment of this invention, the upper air seal 40 comprises a flexible "brush" layer 44 of high temperature-resistant material such as a strip of rubberized conveyor belt-type material, silicone rubber, fire-safe polymer, or Metal Rubber™ of Nano Sonic Inc.) that is environmentally rugged, durable, temperature-stable, and flexible. The brush layer is approximately ¼ to ¾ inches thick. The layer 44 may (FIG. 2) or may not (FIG. 3) contain metal whiskers 46 projecting to within close proximity to the wall 22 and may or may not have a metal plate 48 overlying the brush layer 44. If the brush layer 44 includes metal brush/whiskers 46, they are preferably bonded in the flexible, temperature stable rubber-like belt material and look similar in design to a common rubber-bonded wire wheel with the whiskers 46 projecting approximately ½ to 1 inches or more from the rubber-like material. The metal brush/whiskers are preferably molded in the brush layer 44 but can alternatively be bonded/adhered to either the bottom face or top face of a strip of rubberized belt-type material. The metal whiskers 46 are preferably made of a stainless steel alloy, a sintered-bronze alloy, or other high temperature resistant metal alloy. The metal plate layer 48 is preferably a thin (½") piece of AR-500 plate or its equivalent. The upper air seal 40 is mounted on the rotating throat assembly 34 so the outer edge of the flexible brush layer is close (within approximately 0 to ½ inches) to the surface of the inner wall 22 of the pulverizer or possibly just touching the inner wall. In an embodiment having wire whiskers 46 in the layer 44, whiskers can brush lightly against the inner wall 22 of the pulverizer.

The upper air seal 40 is preferably provided in segments secured on the top the ledge cover segments with bolts not shown. This is preferably done by casting threaded Helicoil Inserts in the ledge cover segments 38 to receive bolts inserted through holes in the metal plate segments 48 and brush layer segments 44 in the upper air seal segments 40. If a metal plate layer is not used, securement bolts and flat washers attach the brush layer segments 44 in the upper air seal segments 40 to the ledge cover segments 38.

This invention may also include a lower air seal 50 secured on the lower outer edge of the throat segments 36 and projecting toward the outer wall 22 of the pulverizer. This lower air seal is preferably disposed slightly above the support ring 28 on the wall 22 to provide resistance to air flow between the lower air seal and the support ring. The minimum clearance partly depends on the overall run-out of the rotating assembly; a clearance of ¼" to ½" is ideal, but may be greater depending on the design of the pulverizer.

The lower air seal 50 is preferably made of AR-500 steel plate or similar high wear resistant material. The lower air seal 50 can also include a layer of conveyor belt material and wire whiskers like the upper air seal 40.

Figure 3:
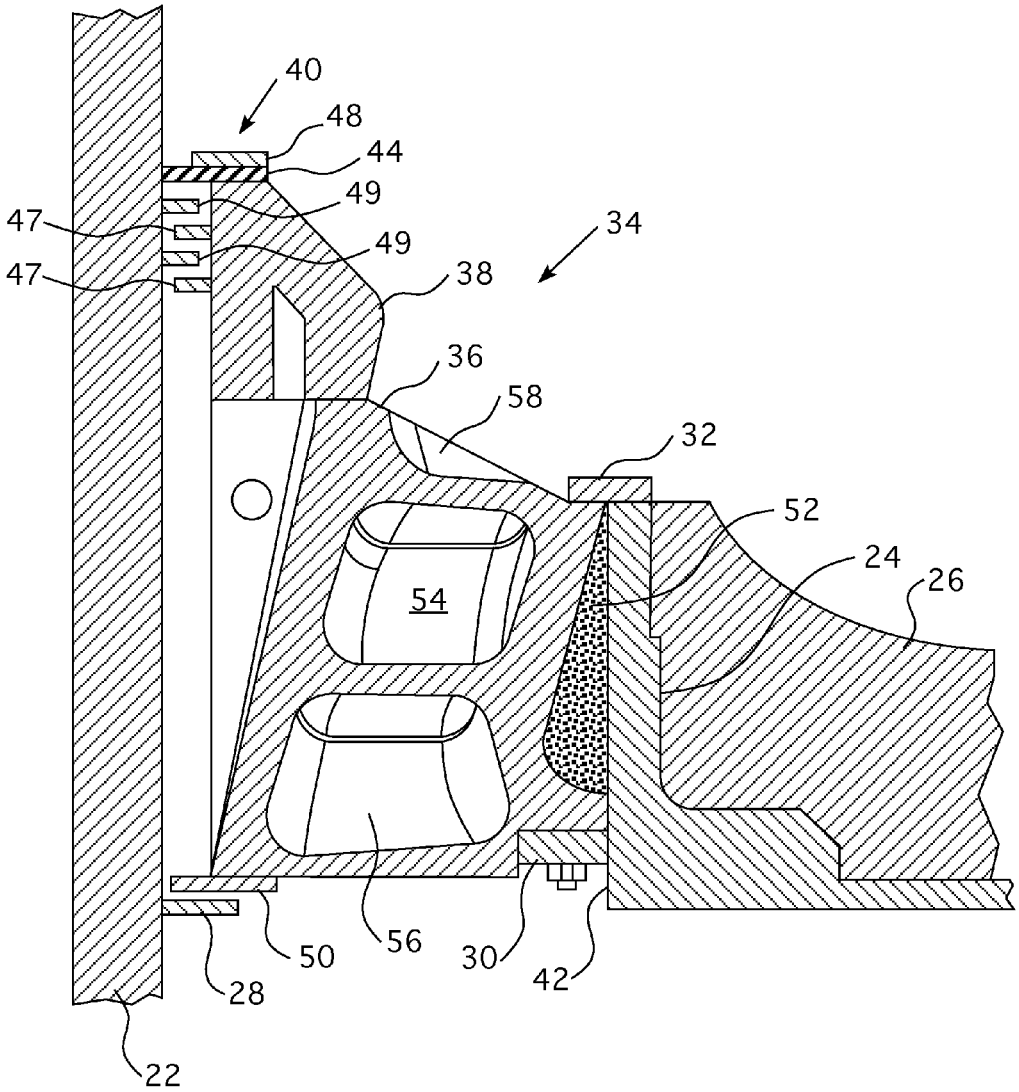
FIG. 3 is a cross sectional view of an alternative design for rotatable throat assemblies of this invention.

FIG. 3 shows an alternative embodiment of this invention, which includes a labyrinth seal between a ledge cover segment 38 and the inner wall 22 of a pulverizer. The labyrinth seal as shown comprises two outwardly projecting ribs 47 on the outer face of the ledge cover segment 38 and two inwardly projecting ribs 49 on the outer wall 22. These ribs 47 and 49 are preferably made of steel and are welded to the ledge cover segment 38 and the inner wall 22. Each of the ribs 47 and 49 is preferably in a range of ½ to 1 inches in cross section and are preferably vertically spaced a minimum of one (1) inch to diffuse any air flow between the ledge cover segments 38 and the wall 22. This adds to the resistance of any flow of tramp air between the ledge cover segments and the wall.

A preferred embodiment of this invention has fire-resistant expanding foam 52 in the cavity between the ring seat 24 and the throat segments 36 to block possible air flow through the cavity and prevent coal particles from becoming packed in this cavity. Some coal, particularly Powder River Basin (PRB) coal, has a propensity to spontaneously ignite, and could be a source of a small fire if allowed to pack into the cavity. Fire and heat resistant foams are well known in the art for uses such as in electrical and heat insulation materials. See for example U.S. Pat. Nos. 5,053,148 and 5,533,737.

Figure 4:
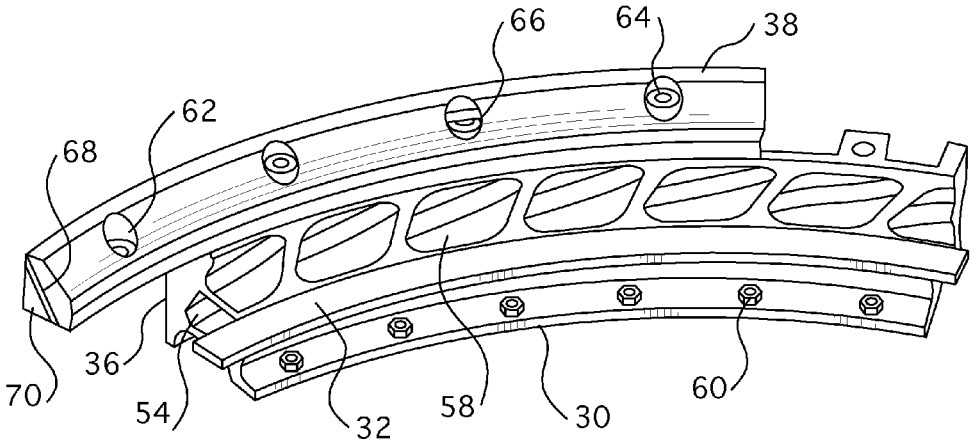
FIG. 4 is a perspective view of a partial assembly of throat segments and edge covers of this invention.
Figure 5:
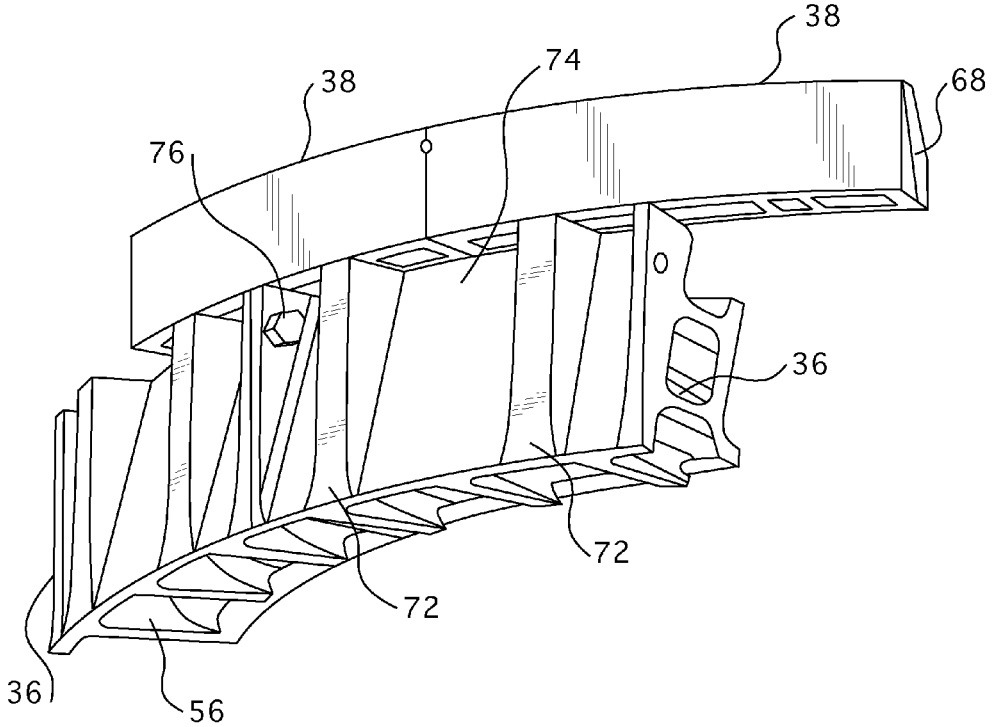
FIG. 5 is another perspective view of a partial assembly of throat segments and edge covers of this invention.

As seen in FIGS. 4 and 5, the throat segments 36 and ledge covers 38 are arcuate in configuration to be concentric with the cylindrical inner wall 22 of the pulverizer when assembled on a pulverizer. Each of the throat segments 36 preferably has a plurality of air channels or ports 54 extending diagonally through it with a lower inlet opening 56 and an upper outlet opening 58. Each of the channels 54 in each segment 36 preferably has the configuration of an elongated twisted parallelogram extending at an angle to vertical. It is believed that such configuration makes it less likely for rocks to plug the channels/ports by reducing the size of an object that can plug the port. Thus the parallelogram configuration provides better air flow through the throat assembly. FIG. 4 shows a plurality of holes in the throat segments 36 for receiving bolts for assembly with the ledge covers 38, mounting ring 30 and contiguous throat segments.

FIG. 4 depicts a partial assembly comprising two throat segments 36, two ledge covers 38, two sections of a mounting ring 30, and a portion of a table seal 32. The ledge cover segments 38 have captive nuts 60 on them over holes in the segments through which bolts are threaded to secure the assembly together. As shown in this figure, the ledge covers 38 have elongated mounting holes 62 in them for receiving bolts 64 for securing the ledge covers to the throat segments 36. Following securement of the ledge covers 38 to the throat segments 36, steel lock tabs 66 are welded in the holes over the heads of the bolts 64 to prevent the bolts from spontaneously backing out and becoming loose. Following the welding of the lock tabs 66 in place, high-temperature silicone sealer is used to fill the elongated holes 62 and provide a smooth top surface on the ledge covers 38.

Each of the ledge covers 38 has semi-circular slots 68 in both end faces 70 for providing and seal between contiguous ledge covers. The slots 68 are ½ inch semi-circular in cross section, and the slots on contiguous covers mirror each other to provide a cylindrical hole at the interface between the ledge covers 38. Following assembly of the ledge covers 38 on the throat segments 36, high-temperature silicone sealer is pumped into the cylindrical hole and a 1 inch sealing rod is tapped into place using a hammer. Application of the sealing rods eliminates tramp air flow from flowing from the backside of the ledge covers 38 to the inside of the ledge covers. This essentially seals a potentially large leak that otherwise could introduce tramp air into the grinding zone from the wrong direction, and would disturb or alter the desired flow through the throat air channels/ports 54 as designed.

FIG. 5 depicts a partial assembly of two throat segments 36 and two ledge cover segments 38 as viewed from the back-side to the segments. As seen in this figure, the back-side of the throat segments 36 have vertical ribs 72 on them which increase in extent from the bottom of the segments to their top to create slots 74 between the throat segments and the wall 22 of a pulverizer. Bolts 76 through the ribs 72 on the OD of the throat segments interconnect contiguous throat segments 36.

The rotating throat segments 36 and cover ledge segments 38 in throat assemblies of this invention are preferably cast from high quality ASTM-552, Class-3, Type-A "White Iron" material, and the mounting ring segments 30 and table seal 32 are preferably made from high quality ¾ inch thick, Super-C material, Rockwell 60 plus C-scale.

It is therefore seen that this invention provides rotating throats for coal pulverizers having improved resistance to the flow of tramp air and increase efficiency and reduce costs. While preferred embodiments have been selected for purposes of description and illustration, it will be apparent to those skilled in the art that numerous variations can be made without departing from the invention or the scope of the claims appended hereto.

What is claimed is:

1. In a coal pulverizer of cylindrical shape and vertical central axis and having a cylindrical inner wall and a rotatable ring seat centered in said inner wall, a rotatable throat assembly comprising:

a radially segmented throat ring comprised of a plurality of arcuate throat segments secured to said rotatable ring seat with each of said plurality of throat segments having vertical air channels through it with each of said air channels having a lower inlet opening and an upper outlet opening; and a plurality of arcuate ledge cover segments secured on the top of said throat segments radially outwardly of said outlet openings, said ledge cover segments having air seal segments secured on them projecting radially outwardly from said throat segments toward said inner wall of the pulverizer, and said air seal segments comprising a strip of flexible, high-temperature resistant, rubberized material projecting to within close proximity to said inner wall of the pulverizer to substantially block air flow between said ledge covers and said inner wall.

2. A rotatable throat assembly as set forth in claim 1 in which said strip of material has wire bristles molded in it projecting to within close proximity to said inner wall of the pulverizer.

3. A rotatable throat assembly as set forth in claim 1 in which each of said air seal segments includes a metal plate overlying said strip of rubberized material and secured to said ledge cover segments.

4. A rotatable throat assembly as set forth in claim 3 in which said metal plate is made of AR steel plate.

5. A rotatable throat assembly as set forth in claim 1 that includes a labyrinth air diffuser on the outer face of each of said plurality of ledge cover segments.

6. A rotatable throat assembly as set forth in claim 5 in which said labyrinth air diffuser comprises at least one outwardly projecting, horizontal rib on the outer face of each of said plurality of ledge cover segments.

7. A rotatable throat assembly as set forth in claim 5 in which said air diffuser includes at least two outwardly projecting horizontal ribs on each of said plurality of ledge cover segments.

8. A rotatable throat assembly as set forth in claim 1, which includes a bottom air seal proximate the bottom edge of the throat assembly comprising a steel plate on each of said arcuate throat segments adjacent to said inner wall of the coal pulverizer.

9. A rotatable throat assembly as set forth in claim 1 in which each of said plurality of ledge cover segments abuts against ledge cover segments on both lateral ends thereof and each of said plurality of ledge cover segments has a semi-circular groove in both lateral end faces thereof directly facing semi-circular grooves in the lateral end faces of the abutting ledge cover segments to form cylindrical holes which are is adapted to receive cylindrical steel sealing rods and high-temperature silicone sealer to enhance the seal between the abutting ledge cover segments.

10. A rotatable throat assembly as set forth in claim 1 in which each of said plurality of throat segments has a cavity in its inner face that is contiguous with the outer face of said rotatable ring seat of the coal pulverizer, and said cavity is filled with fire retardant foam.

11. A kit comprising a plurality of throat segments, ledge cover segments and air seal segments that are adapted to be assembled to form a rotatable throat inside a coal pulverizer of cylindrical shape and vertical central axis and having a cylindrical inner wall and a rotatable ring seat centered in said inner wall, said kit comprising:

a plurality of arcuate throat segments defining a plurality of vertical air channels each of which has a lower inlet opening and an upper outlet opening;

a plurality of arcuate ledge cover segments adapted to be secured on said plurality of throat segments radially outward of said upper outlet openings; and a plurality of air seal segments adapted to be secured overlying said ledge cover segments, and each of said plurality of air seal segments comprises a strip of flexible, high-temperature resistant, rubberized material for securement on top of said ledge cover segments, whereby said plurality of throat segments, ledge covers and air seal segments are adapted to be secured to said rotatable ring seat in a coal pulverizer and in which said strips of rubberized material are adapted to project to within close proximity of said inner wall of a pulverizer to substantially block air flow between said ledge cover segments and said inner wall of the pulverizer.

12. A kit as set forth in claim 11 in which each of said plurality of air seal segments has a metal plate overlying said strip of flexible, rubberized material.

13. A kit as set forth in claim 11 in which each of said ledge cover segments has at least one horizontal rib on the outer face thereof which is adapted to project toward said inner wall of said pulverizer and form a labyrinth seal with said inner wall.

14. A kit as set forth in claim 11 in which each of said plurality of ledge cover segments has a semi-circular groove in both lateral end faces and, upon securement of said ledge cover segments on said throat segments, said semi-circular grooves in contiguous abutting ledge cover segments are adapted to form cylindrical holes for receiving cylindrical sealing rods for enhancing the seal between abutting ledge cover segments, and said kit includes a plurality of steel rods for securement in said holes in said ledge cover segments.

15. A kit as set forth in claim 11 in which each of said plurality of throat segments has an inwardly projecting rib thereon adjacent to its bottom edge which is adapted to form a bottom air seal with said inner wall of the pulverizer when said plurality of throat segments are secured to said rotatable ring seat in the pulverizer.

16. A kit as set forth in claim 11 in which said strip of rubberized material has wire bristles molded in it for projecting to within close proximity of said inner wall of a pulverizer.

17. A rotatable throat assembly as set forth in claim 3 in which said metal plate is made of high wear resistant material.

* * * * *